US006758718B1

(12) United States Patent
Morris

(10) Patent No.: US 6,758,718 B1
(45) Date of Patent: Jul. 6, 2004

(54) TOY POLICE CAR WITH REALISTIC LIGHT AND SOUND DISPLAY

(76) Inventor: John Morris, 414 Maple Ave., Horsham, PA (US) 19044

( * ) Notice: Subject to any disclaimer, the term of this patent is extended or adjusted under 35 U.S.C. 154(b) by 0 days.

(21) Appl. No.: 10/410,017

(22) Filed: Apr. 9, 2003

(51) Int. Cl.[7] ..... A63H 17/00; A63H 17/28
(52) U.S. Cl. ..... 446/431; 446/438
(58) Field of Search ..... 446/438, 432, 446/439, 431; 340/426.1–426.36; 362/545, 543, 540, 542, 251

(56) References Cited

U.S. PATENT DOCUMENTS 1,912,545 A * 6/1933 Smith ..... 446/439
3,187,462 A * 6/1965 Licitis ..... 446/439
4,219,962 A * 9/1980 Dankman et al. ..... 446/409
4,717,366 A 1/1988 Ishimoto ..... 446/470
4,813,907 A * 3/1989 Rissman et al. ..... 446/175
5,791,967 A * 8/1998 Yeh ..... 446/279
5,908,345 A 6/1999 Choi ..... 446/436
6,011,489 A * 1/2000 Ki Kwan et al. ..... 340/825.72
6,083,104 A * 7/2000 Choi ..... 463/6
6,250,987 B1 * 6/2001 Choi ..... 446/436

* cited by examiner

*Primary Examiner*—Derris H. Banks
*Assistant Examiner*—Faye Francis
(74) *Attorney, Agent, or Firm*—Goldstein Law Offices, P.C.

(57) ABSTRACT

A simulated emergency vehicle display, for providing realistic light and sound in a toy emergency vehicle having a housing, having a front, a back, and a roof. A pair of headlights are located at the front, a pair of tail lights are located at the rear, and a plurality of light bar LEDs are located on the roof. A control circuit alternately illuminates each of the headlights, alternately flashes each of the tail lights three times, and repeatedly illuminates the light bar LEDs in sequence to simulate motion by the light bar LEDs. A speaker is selectively activated to provide a realistic siren sound.

6 Claims, 5 Drawing Sheets

50

| FIG. 3A | FIG. 3B |
|---|---|

TOY POLICE CAR WITH REALISTIC LIGHT AND SOUND DISPLAY

BACKGROUND OF THE INVENTION

The invention relates to a toy police car with realistic light and sound display. More particularly, the invention relates to a toy police car which has electronic circuitry configured to provide a remarkably realistic light and sound display.

While a tremendous variety of toys are available for today's children, including learning toys, board games, video games, etc. 'occupational' toys still are among the most popular. In other words, toys which allow a child to pretend to be a firefighter, a construction worker, an astronaut, or a policeman tend to be the most popular. Toy figures and toy vehicles are typical props in such play.

Among all such toys, the toy police car has been one of the most popular. A failing in toy police cars have been their ability to simulate the lights and sounds of a real police car. Some provide a siren. Some provide a flashing light bar. None, however are configured to simulate an actual modern police car—which often not only has a light bar, but flashes the headlights and tail lights as well.

In addition, while model police cars are often built by hobbyists to painstaking detail, they still do not provide a light and sound display with comparable realistic detail. Similar limitations occur in model ambulances and fire trucks, where the physical detail is striking, yet there is little operative realism in comparison to the complex light and sound patterns generated by their modern, full size counterparts.

While these units may be suitable for the particular purpose employed, or for general use, they would not be as suitable for the purposes of the present invention as disclosed hereafter.

SUMMARY OF THE INVENTION

It is an object of the invention to produce a toy police car which has a light and sound display which simulates an actual police car. Accordingly, the car includes a light bar comprising two red and two blue lights, a pair of head lights, and a pair of tail lights, a speaker, and a control circuit, which flashes all of said lights in a predetermined fashion and generates a siren sound through the speaker.

It is a further object of the invention to simulate rotating lights of a police car light bar without moving parts. Accordingly, the lights in the light bar of the present invention are four LEDs (Light Emitting Diodes), which are lit in succession using four of ten outputs of a decade counter.

It is another object of the invention to provide a toy police car which, rather than simply flashing its lights on and off, actually simulates the complex flashing patterns of a modern police car. Accordingly, the headlights flash in an alternating fashion, and the tail lights flash such that one of the tail lights flashes on three times in quick succession, and then remains off while the other tail light flashes on three times in quick succession.

It is a still further object of the invention to provide a toy police car which has a siren, which when selectively activated, produces a complex siren sound. Accordingly, a square wave generator operates in conjunction with a phased lock loop, through an analog switch, to create a unique sound which is still remarkably reminiscent of emergency vehicle sirens.

The invention is a simulated emergency vehicle display, for providing realistic light and sound in a toy emergency vehicle having a housing, having a front, a back, and a roof. A pair of headlights are located at the front, a pair of tail lights are located at the rear, and a plurality of light bar LEDs are located on the roof. A control circuit alternately illuminates each of the headlights, alternately flashes each of the tail lights three times, and repeatedly illuminates the light bar LEDs in sequence to simulate motion by the light bar LEDs. A speaker is selectively activated to provide a realistic siren sound.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 3B is illustrated diagrammatically by FIG. 3.

DETAILED DESCRIPTION OF THE PREFERRED EMBODIMENTS

Figure 1:
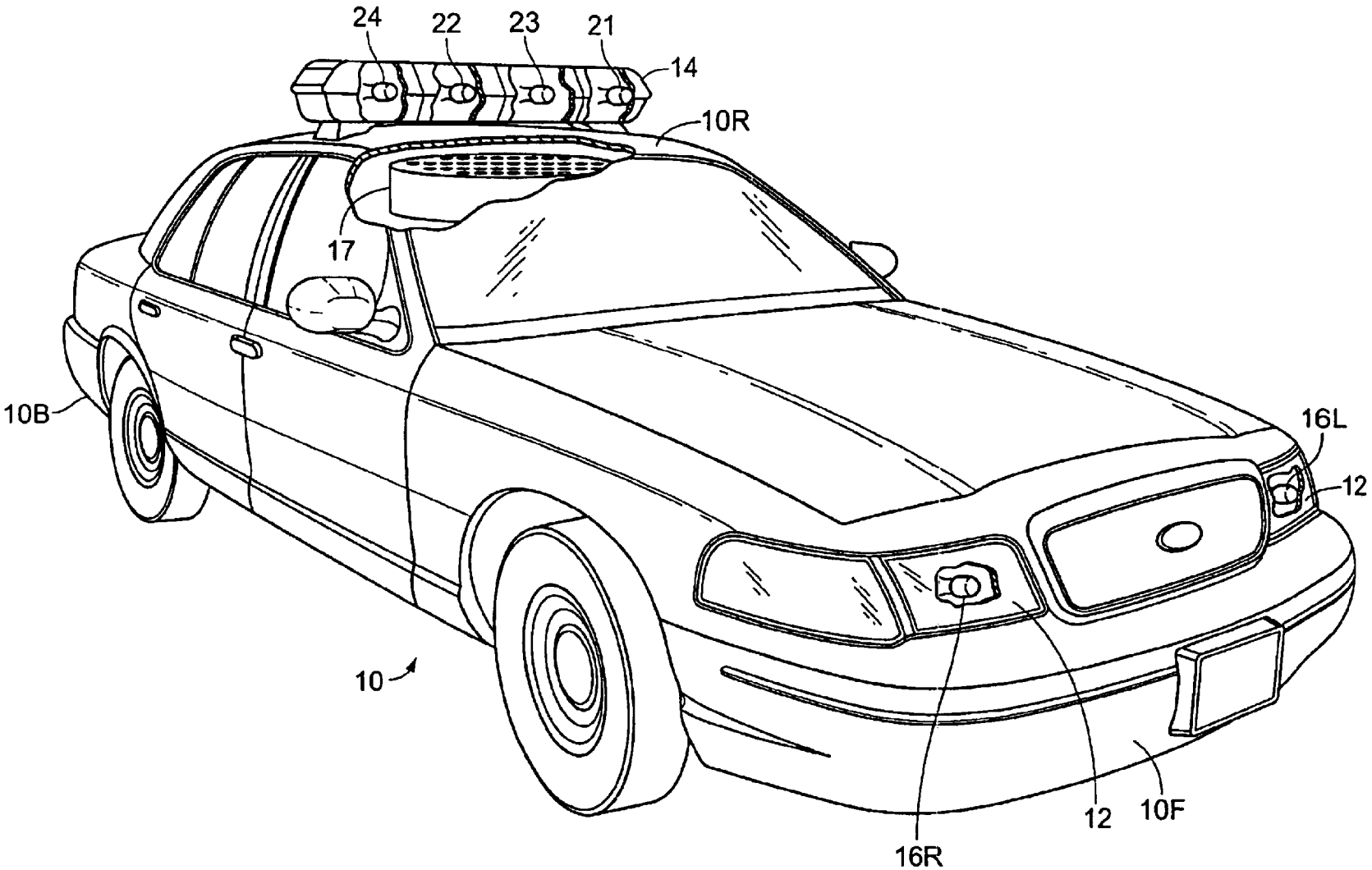
FIG. 1 is a diagrammatic perspective view, illustrating a model police car, wherein the front headlight lenses, the light bar, and the windshield have been broken away to illustrate light bulbs, LEDs and a speaker, respectively, contained therein.

FIG. 1 illustrates a toy emergency vehicle 10, which is illustrated herein as a toy police car. The invention may also be embodied, however, in the form of a model or toy ambulance, fire truck, or any other emergency vehicle. The toy vehicle i has housing in the shape of an emergency vehicle having a front 10F, a back 10B, and a roof 10R. The toy vehicle 10 has a pair of headlight lenses 12 at the front 10F, and has a light bar 14 mounted on the roof 10R.

Left and right headlight bulbs 16L, 16R are mounted behind the headlight lenses 12. Accordingly, the headlight lenses are transparent or translucent. In addition, first, second, third, and fourth light bar LEDs 21, 22, 23, 24 are mounted within the light bar 14. Preferably, two of the light bar LEDs 21, 23 are blue colored LEDs which are adjacent to each other in the light bar 14, and two of the light bar LEDs 22, 24 are red colored LEDs which are adjacent to each other in the light bar 14. The two red light bar LEDs 22,24 are together adjacent to the two blue light bar LEDs 21,23. Further, a speaker 17 is mounted within the vehicle 10, and is preferably positioned such that sound emanating therefrom permeates through the housing and is not unduly muted by the housing.

Figure 2:
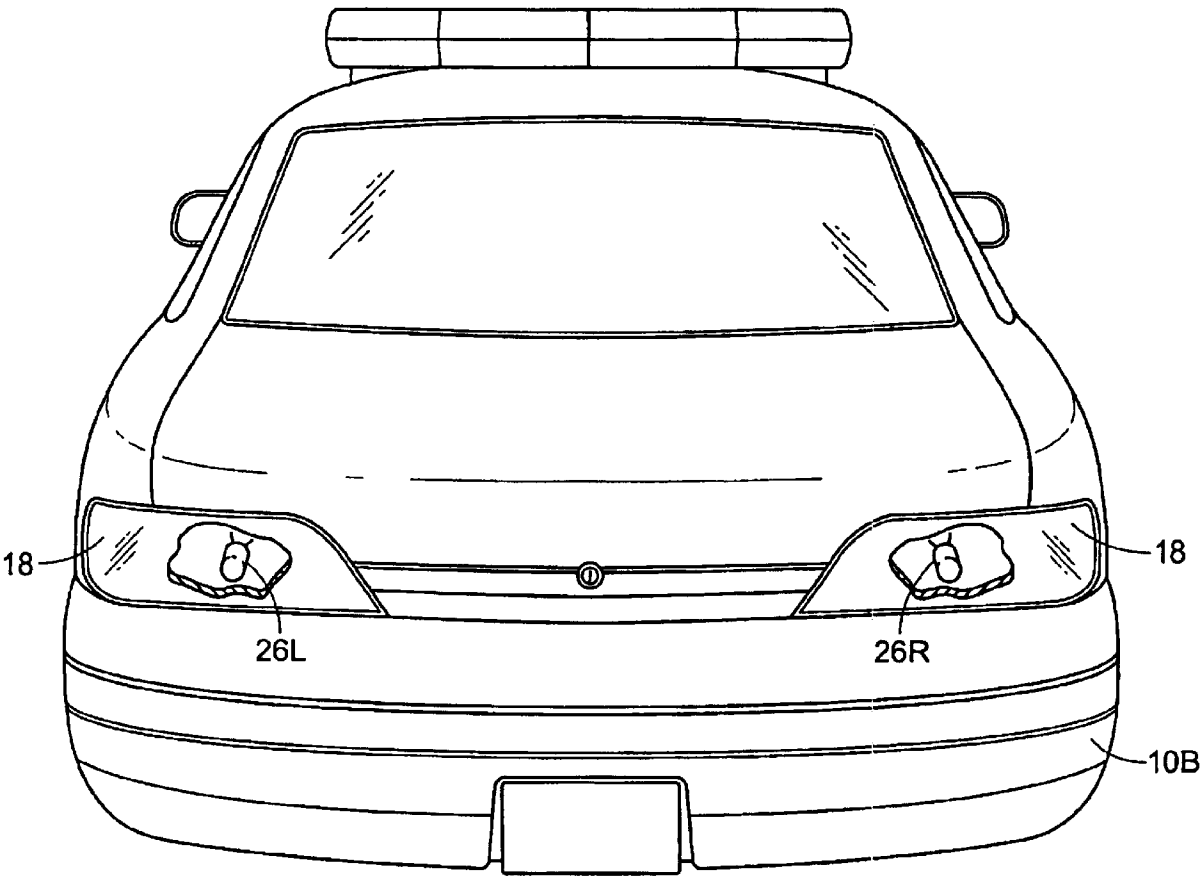
FIG. 2 is a rear elevational view, illustrating the tail light lenses broken away to illustrate LEDs contained therein.

FIG. 2 illustrates tail light lenses 18 at the vehicle back 10B. Left and right tail light LEDs 26L, 26R are mounted behind the tail light lenses 18. The tail light lenses 18 are preferably red in color in accordance with typical vehicle tail lights and are also transparent. The tail light LEDs 26L, 26R, are preferably red colored LEDs.

Figures 3, 3A:
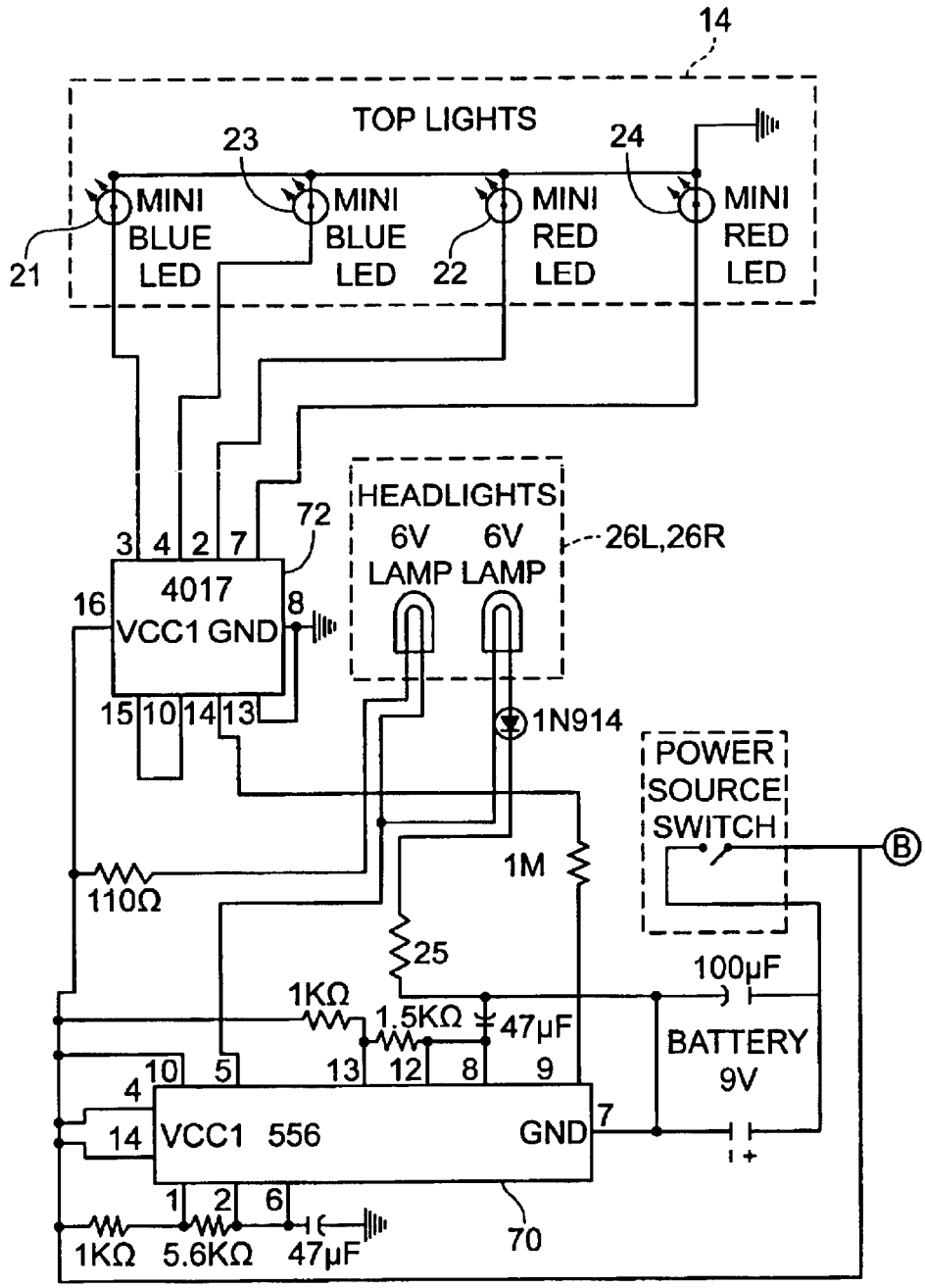
FIG. 3A and FIG. 3B are schematic drawings of the lighting and sound circuitry—wherein the headlight and light bar portions of the control circuit are illustrated in FIG. 3A; the tail light and siren portions of the control circuit are illustrated in FIG. 3B; and the orientation of FIG. 3A
Figure 3B:
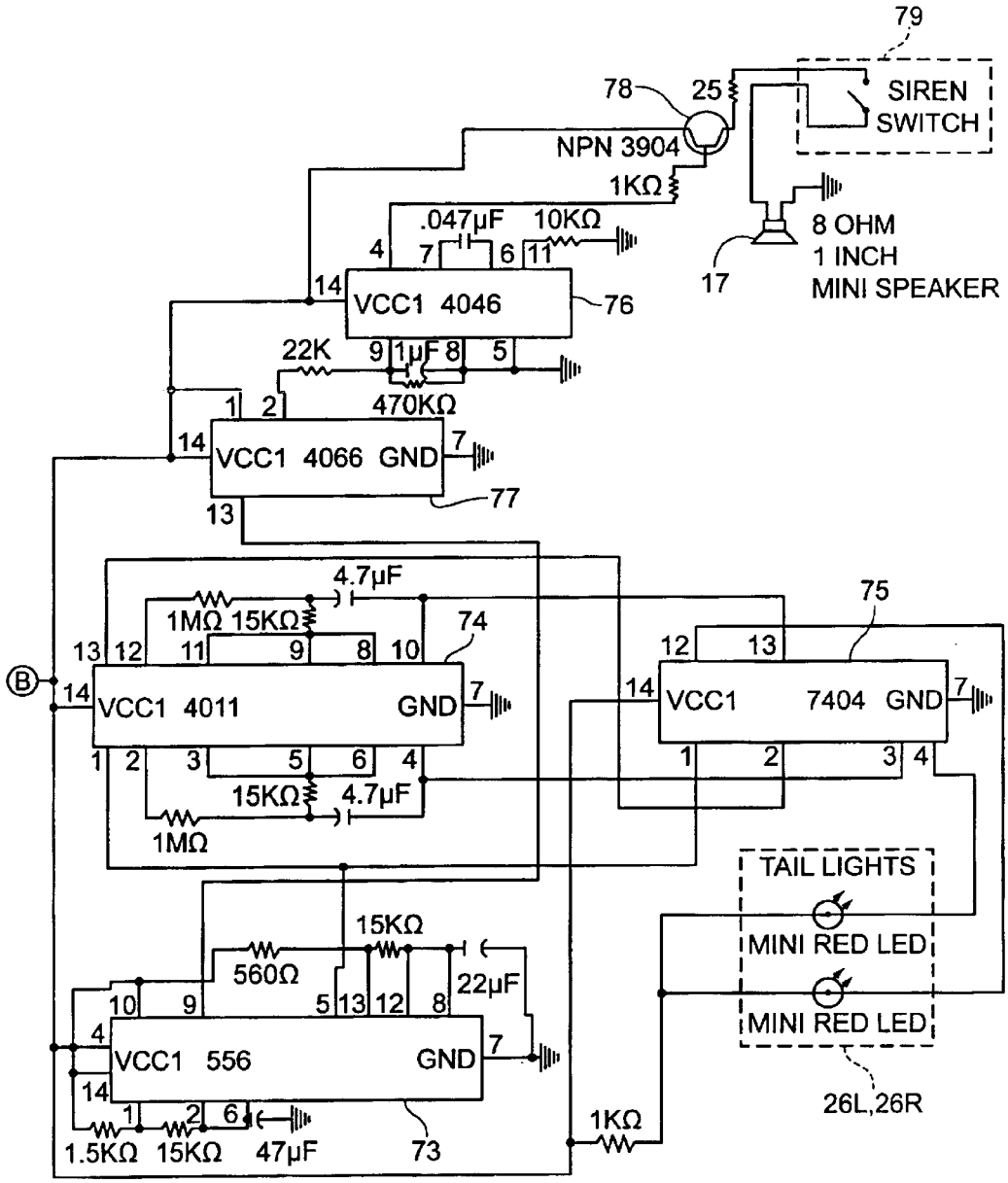

FIG. 3A and FIG. 3B set forth the best mode of the inventor for a control circuit 50, which sets forth preferred part numbers for integrated circuits; values for resistors, capacitors, diodes, and transistors; as well as the interconnection thereof—including pin numbers for the integrated circuits. Note that for clarity, it should be understood that all numerals indicated in drawings figures FIG. 3A and 3B are either pin numbers, part numbers, or a part value—the difference between each being well understood by those skilled in the art—unless such numeral is accompanied by a curved lead line, in which case it is a 'reference numeral' particular to the present description of the invention. The functionality of the circuitry can be readily determined by those skilled in the art, and certainly can be implemented thereby without undue experimentation. Such functionality is, however, more readily understood by cursory examination with reference to the higher level block diagram provided in FIG. 4.

Figure 4:
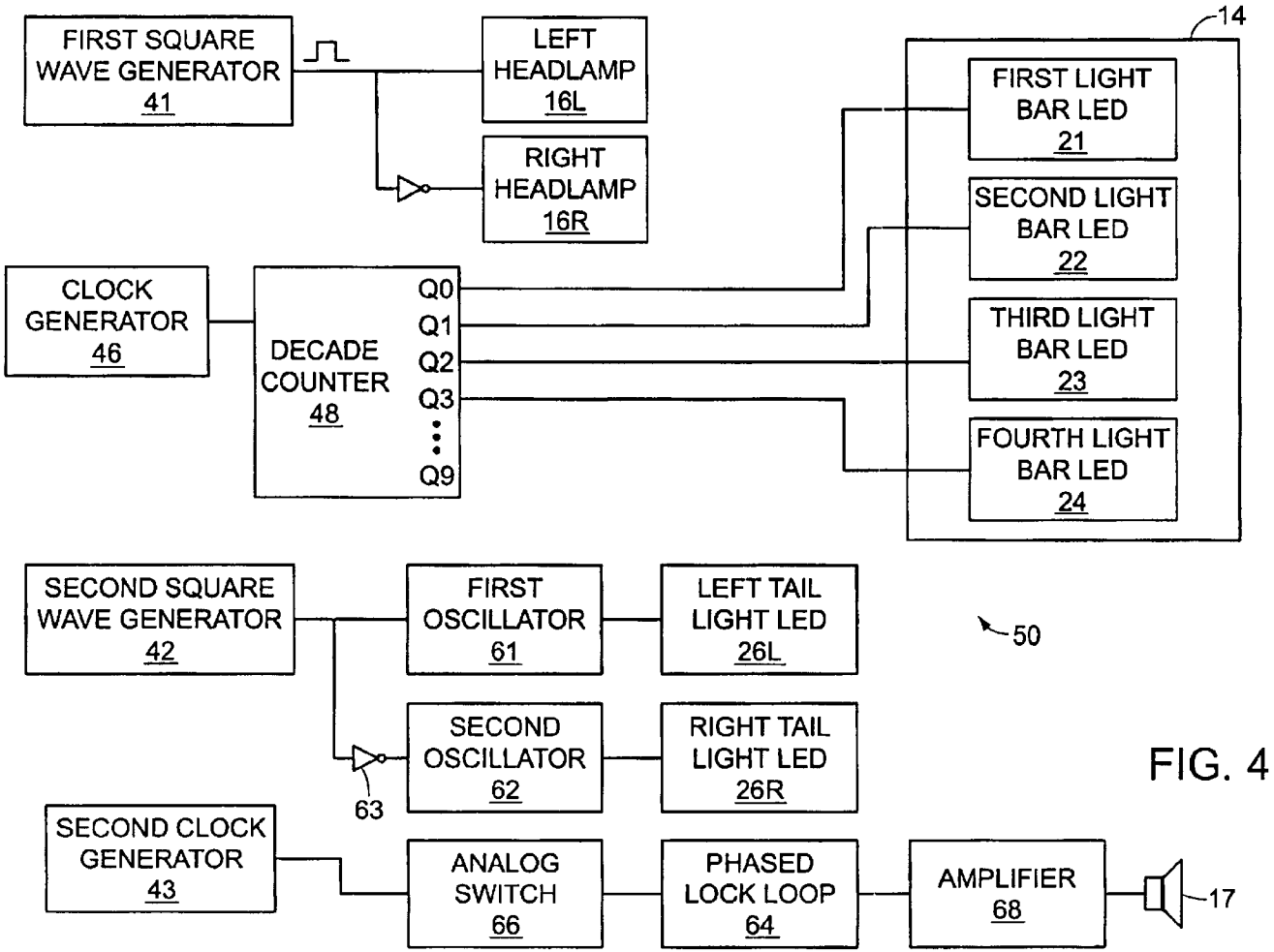
FIG. 4 is a block diagram, providing a higher level functional description of the control circuitry and associated components.

FIG. 4 illustrates the control circuit 50, including a first square wave generator 41, which drives the left head light 16L, and which drives the right head light 16R through an inverter 44. Accordingly, the first square wave generator 41 alternately and mutually exclusively illuminates the left head light 16L and right head light 16R.

In addition a clock generator 46 generates a pulse which drives a decade counter 48. The decade counter sequentially enables four of its ten outputs, Q0 through Q10, with each pulse from the clock generator 46, and then repeats the sequence. In accordance with the purposes of the present invention, the first, second, third, and fourth light bar LEDs 21, 22, 23, and 24 are connected to outputs Q0 through Q3 of the decade counter. Accordingly, with each pulse of the clock generator 46, each of outputs Q0 through Q3 is successively enabled, and the first, second, third, and fourth light bar LEDs 21, 22, 23, and 24 are successively illuminated. Then, the sequence repeats. Accordingly, due to their staggered positioning on the light bar as described above, during each sequence, one blue (21), one red (22), the other blue (23), and then the other red (24) LEDs illuminate. This arrangement provides the substantially realistic simulation of motion of a real emergency vehicle light bar—without moving parts. Note, however, that the key to the realism is the alternation of color and position. In the alternative, illuminating in sequence one red, one blue, the other red, and then the other blue LED would be functionally equivalent.

A second square wave generator 42 supplies an output that enables a first oscillator 61, and enables a second oscillator 62 through an inverter 63. Accordingly, the first oscillator 61 and second oscillator 62 alternatively and mutually exclusively operate. The first and second oscillator 61, 62 are both configured to generate three quick pulses while enabled (during each half cycle of the second square wave generator). The first oscillator 61 drives the left tail light LED 26L, and the second oscillator 62 drives the right tail light LED 26R. Accordingly, when properly configured, by the proper selection of components as illustrated in FIG. 3B, the left tail light LED 26L will illuminate three times as three quick flashes, alternating with the right tail light LED 26R illuminating three times as three quick flashes. Thus, a realistic 'strobe' tail light effect is generated.

A second clock generator 43 is used to drive a phased lock loop 64, through an analog switch 66. The phased lock loop 64 acts as a voltage controlled oscillator and produces an output that drives the speaker 17 through an amplifier 68. With the proper selection of components as those illustrated in FIG. 3B, the phased lock loop 64 is configured so as to generate a realistic 'police car like' siren.

The functionality of the control circuit 50 has thus been described in detail with reference to FIG. 4. However, reference can now be made to FIG. 3A and FIG. 3B to integrate the schematic embodied therein with the block diagram of FIG. 4. In particular, in FIG. 3A a first '1556' dual timer 70 is used to create the first square wave generator (41 in FIG. 4), which drives the left and right head lights 16L and 16R, the connection of which to opposite power supply terminals results in their mutual exclusive and alternate illumination.

Further, the first '556' dual timer 70 also serves as the clock generator (46 in FIG. 4), which clocks a '4017' decade counter chip 72 (48 in FIG. 4). The decade counter chip 72 drives the first, second, third, and fourth light bar LEDs 21, 22, 23, and 24.

Thus, FIG. 3A illustrates that portion of the control circuit 50 which controls the head lights 16L, 16R, and first, second, third, and fourth tail light LEDs 21, 22, 23, 24. Other than of course sharing a common ground reference, FIG. 3B is connected to FIG. 3A by a single node, labeled as node 'B', which is a positive power source node. FIG. 3B illustrates that portion of the control circuit 50 which controls the tail lights 26L, 26R, and drives the speaker 17.

In particular, a second '556' dual timer chip 73 is used to provide the second square wave generator (42 in FIG. 4) and second clock generator (43 in FIG. 4). The second square wave generator (42 in FIG. 4) is used to alternatively enable the first and second oscillator 61 and 62, whereby the inverter 63 is used to enable the second oscillator in alternation with the first oscillator, is implemented by a configuration of NAND gates and inverters, and provided in a '4011' quad 2-input NAND gate chip 74 and a '7404' hex inverter chip 75, and their connection to the tail light LEDs 26L, 26R.

The second clock generator (43 in FIG. 4) provided by the second '556' dual timer chip 73 provides a VCO input to a '4046' phased lock loop chip 76, through a '4066' quad analog switch chip 77. A VCO output from the phased lock loop chip 76 drives the speaker through a 'NPN 3904' transistor 78 which serves as the amplifier (68 in FIG. 4) for the speaker 17. Not illustrated in FIG. 4, however, the speaker, and thus the siren sound emanating therefrom, may be selectively enabled or disabled using a siren control switch 79 connected between the transistor 78 (amplifier 68) and the speaker 17.

Thus, herein is provided a control circuit which works in conjunction with head lights, light bar LEDs, tail light LEDs, and a speaker to provide a realistic audio/visual display from a toy or model police car, ambulance, fire truck, or other emergency vehicle. The invention is illustrated by example in the attached drawing figures and in the foregoing description. Numerous variations therefrom, however, are possible while adhering to the inventive concept. Such variations are contemplated as being a part of the present invention.

What is claimed is:

1. A model emergency vehicle, for providing a miniaturized realistic display simulating a real emergency vehicle, comprising:

a housing, in the shape of an emergency vehicle, having a front, a back, and a top;

a pair of head lights;

a pair of tail lights;

a light bar having a plurality of light bar LEDs;

a control circuit, which when activated alternately illuminates each of the head lights, alternately repetitively flashes each of the tail lights, illuminates each of the plurality of light bar lights in a repeating sequence, wherein the control circuit alternately flashes on one of the tail lights three times, and flashes on the other of the tail lights three times, and wherein the control circuit comprises a decade counter, having ten outputs, and wherein each of the plurality of light bar LEDs is uniquely connected to one of the outputs of the decade counter.

2. The model emergency vehicle as recited in claim 1, wherein two red and two blue colored LEDs are provided as the plurality of light bar LEDs, which are thereby connected to four of the ten outputs of the decade counter.

3. The model emergency vehicle as recited in claim 2, wherein the two blue LEDs are adjacent to each other on the light bar, the two red LEDs are adjacent to each other on the light bar, and wherein the two red LEDs are together adjacent to the two blue LEDs.

4. The model emergency vehicle as recited in claim 3, wherein the light bar LEDs are connected to the decade counter outputs so that for each repeated sequence, one blue, one red, the other blue, and then the other red LED is illuminated to simulate motion with the light bar.

5. The model emergency vehicle as recited in claim 4, wherein the control circuit further comprises a pair of oscillators, each of the oscillators alternately enabled, one of the oscillators driving one of the tail lights, and the other of the oscillators driving the other one of the tail lights, the oscillators clocked and configured so that they each alternately provide three pulses which are used to alternately pulse each of the tail light LEDs three times in a row.

6. The model emergency vehicle as recited in claim 5, further comprising a speaker, a siren speaker switch, and further comprising a phased lock loop connected to the speaker through the siren switch, for generating a siren sound when enabled by the siren speaker switch.

* * * * *